US011359433B2

(12) United States Patent
Toth

(10) Patent No.: US 11,359,433 B2
(45) Date of Patent: Jun. 14, 2022

(54) RETRACTABLE BOARDED WINDOW COVERING APPARATUS

(71) Applicant: Adam Joseph Toth, Piscataway, NJ (US)

(72) Inventor: Adam Joseph Toth, Piscataway, NJ (US)

( * ) Notice: Subject to any disclaimer, the term of this patent is extended or adjusted under 35 U.S.C. 154(b) by 33 days.

(21) Appl. No.: 16/989,120

(22) Filed: Aug. 10, 2020

(65) Prior Publication Data

US 2021/0062574 A1 Mar. 4, 2021

Related U.S. Application Data

(60) Provisional application No. 62/894,769, filed on Aug. 31, 2019.

(51) Int. Cl.
*E06B 9/24* (2006.01)

(52) U.S. Cl.
CPC ..... *E06B 9/24* (2013.01)

(58) Field of Classification Search
CPC ..... E06B 9/24; E06B 9/02; E06B 9/04; E06B 2009/005; A47H 2001/021; A63C 11/028; Y10S 248/912
See application file for complete search history.

(56) References Cited

U.S. PATENT DOCUMENTS 3,816,964 A * 6/1974 Catalano ..... E05D 15/0608 49/127
4,272,934 A * 6/1981 Cowden ..... E06B 3/28 52/202
2009/0151276 A1* 6/2009 Debes, Jr. ..... E06B 9/02 52/203
2018/0258688 A1* 9/2018 Jones ..... E05D 15/0682

* cited by examiner

*Primary Examiner* — Daniel P Cahn
*Assistant Examiner* — John W Hanes, Jr.
(74) *Attorney, Agent, or Firm* — Walter J. Tencza, Jr.

(57) ABSTRACT

A window covering apparatus is disclosed, along with a method of using the same. The apparatus may include an upper board component and a lower board component, which are releasably held by central mounts. The upper board and lower board components can be arranged in a fully open shutter state, a half open shutter state, or a fully closed shutter state. The central mounts are positioned near flush to one or more outside or surrounding window surfaces in order to block light transmission. In one embodiment, the upper board and/or the lower board component may incorporate decorative elements and a gapless seam between the upper board and lower board components.

18 Claims, 4 Drawing Sheets

FIG. 2
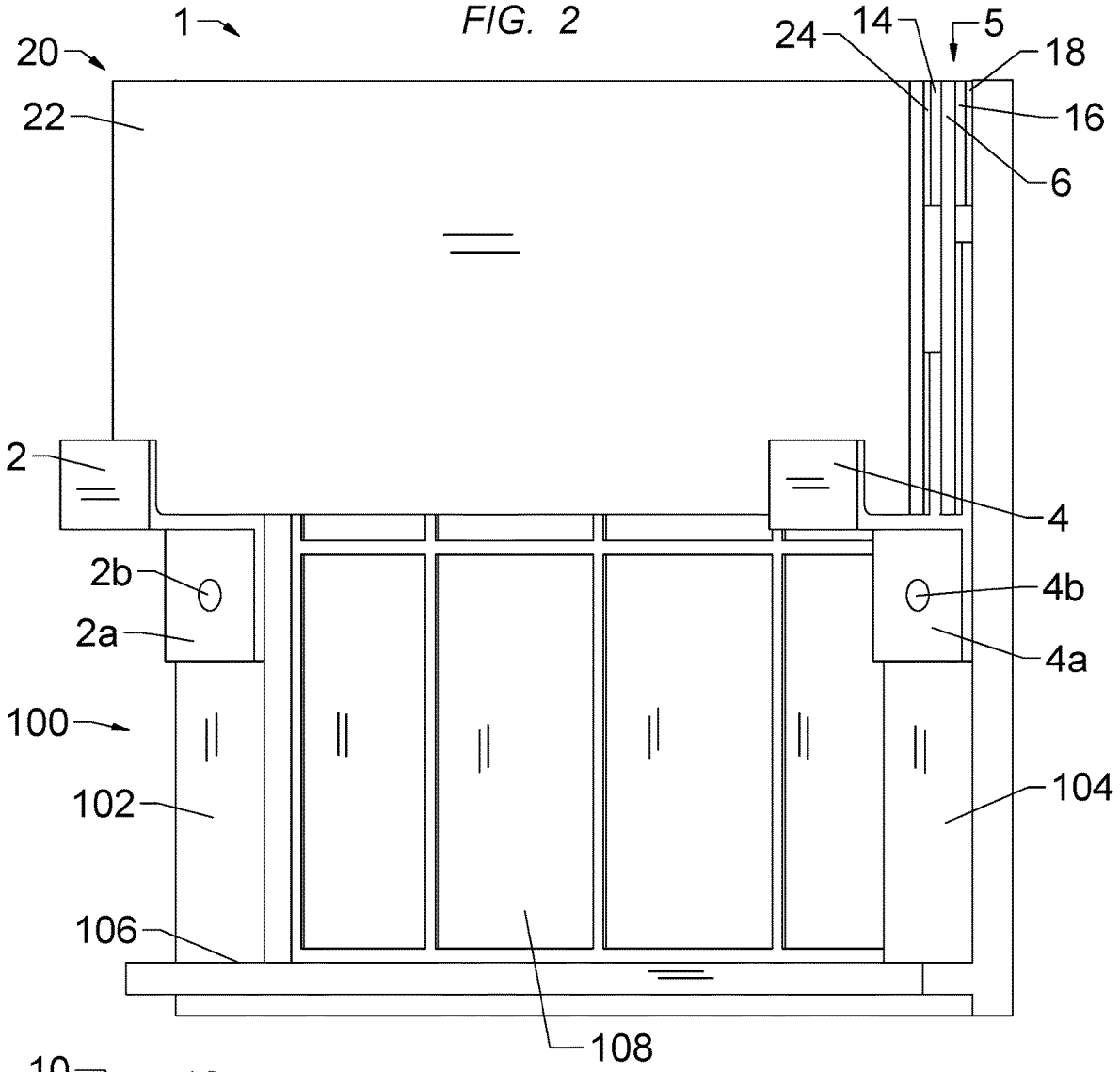
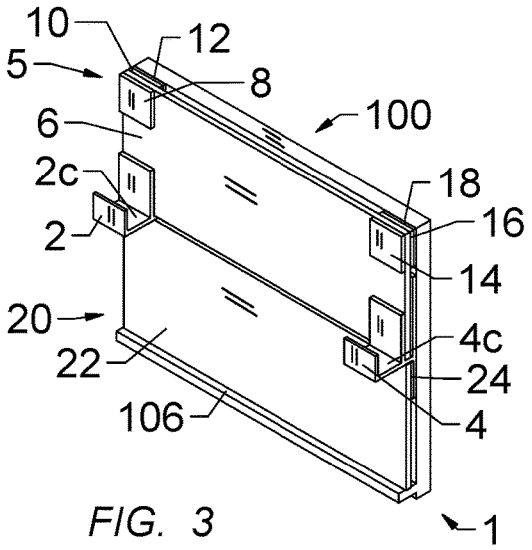
FIG. 3
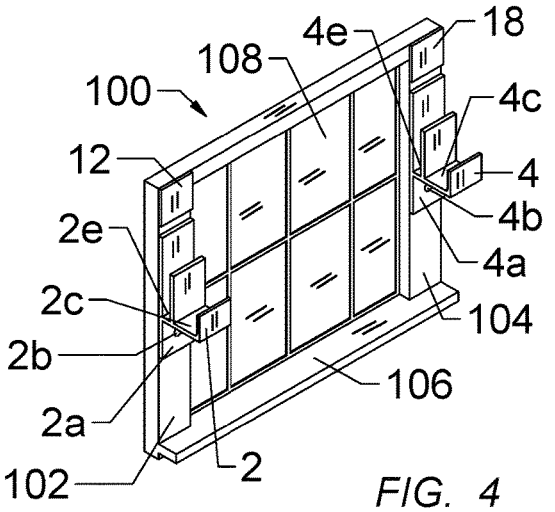
FIG. 4

RETRACTABLE BOARDED WINDOW COVERING APPARATUS

CROSS REFERENCE TO RELATED APPLICATION(S)

This application claims the priority of U.S. provisional patent application, Ser. No. 62/894,769, filed on Aug. 31, 2019, inventor and applicant Adam Joseph Toth, titled "RETRACTABLE BOARDED WINDOW COVERING APPARATUS."

FIELD OF THE INVENTION

The present invention relates to the field of window coverings.

BACKGROUND OF THE INVENTION

Many types of window coverings exist today, such as, but not limited to, roller shades, horizontal and vertical slatted shades, fabric draw string shades, fabric curtains, and drapes.

Accompanying all of the different types of window coverings are numerous hardware mounting options to secure the said window coverings in place. These types of mounting options require specialized tools to install correctly and are permanent fixtures as they are secured with fasteners that extend into the wall or other mating surfaces.

The said window coverings and their central mounts can be tedious to clean.

The said window coverings are loose and flexible, and do not provide a near perfect flushness to the window or wall as to prevent light from the outside of the window from entering.

The loose nature and the non-perfect flushness of the said window coverings to the window sill create a gap in which outside air can flow under. This is apparent when air temperature outside of a window can create a cold downward air draft effect into the room.

SUMMARY OF THE INVENTION

One or more embodiments provide a window covering comprised of sheet boards that can be easily installed, retracted, and/or removed due to specialized mounting hardware.

A principal object of one or more embodiments of the present invention is to address the foregoing needs.

The present invention is comprised of mounting hardware that requires no specialized tools to install and is fixed to a surrounding one or more window surfaces with a non-damaging, easily removable adhesive.

In one preferred embodiment, the boards that comprise the present invention are flat, smooth, lightweight, and require no more than a feather dusting device to remove dust and debris particles from it. The mounting hardware of the present invention is positioned at a height half that of the entire window, allowing it to be reached easily and cleaned. Due to the lightweight nature of the boards and due to the non-permanent mounting feature, the board components can be easily removed and flipped around to further clean the opposing side.

Another aspect of the present invention is that the mounting hardware is near flush with the surrounding one or more window surfaces of a window and outside of glass window panel(s) of a window, such as one or more window surfaces of the casing, frame, head, or jambs of the window, and holds comprising non-light-transmitting board components which, together, allow very little light transmission.

The lower board of the apparatus can be supported by a flat window sill or window stool, creating a perfectly flush interface between the board and the window sill or stool, which reduces cold download air drafts into the room.

In at least one embodiment of the present invention, a window covering apparatus is provided comprising: an upper board component and a lower board component; and one or more central mounts, which engage one or more window surfaces of a window outside of one or more glass panels of the window and which are configured to releasably attach the said upper board component and the said lower board component to the one or more window surfaces of the window in any one of a half-open shutter state, or a fully closed shutter state, and to allow the upper board component and the lower board component to be detached from the one or more window surfaces in a fully open shutter state.

In at least one embodiment, the one or more central mounts include a first central mount and a second central mount.

Each of the one or more central mounts may include a front slot and a rear slot; wherein each of the front slots are configured to receive at least a portion of the lower board component; and wherein each of the rear slots are configured to receive at least a portion of the upper board component.

The window covering apparatus may further include one or more sheet mounts configured to be attached to the one or more window surfaces; wherein the upper board component is configured to be attached to the one or more sheet mounts to attach the upper board component to the one or more window surfaces.

The window covering apparatus may further include one or more magnets; and wherein the upper board component is configured to be attached to the one or more sheet mounts through the one or more magnets.

In at least one embodiment, in the fully closed shutter state, the upper board component and the lower board component do not overlap each other; and in the half-open shutter state, the lower board component overlaps the upper board component.

In at least one embodiment, in the half open shutter state, the lower board component is attached to the upper board component by one or more magnets.

In at least one embodiment, in the fully closed shutter state, the lower board component is attached to the one or more central mounts by one or more magnets.

A method is also provided which may include attaching one or more central mounts of a window covering apparatus to one or more surfaces of a window outside of one or more glass panels of the window. The window covering apparatus may be configured as previously described. The method may further include attaching the lower board component to the one or more central mounts, and attaching the upper board component to the surfaces of the window so that the lower board component does not overlap the upper board component in the fully closed shutter state. The method may further include attaching the upper board component to the surrounding surfaces of the window and attaching the lower board component to the upper board component so that the lower board component overlaps the upper board component in the half open shutter state.

BRIEF DESCRIPTION OF THE DRAWINGS

FIG. 2 is a front and right side perspective view of the apparatus of FIG. 1A mated to a surrounding window surface with the apparatus of FIG. 1A shown in half open shutter state;

FIG. 3 is a front, top, and right side perspective view of the apparatus of FIG. 1A mated to the surrounding window surface of FIG. 2 with the apparatus of FIG. 1A in a fully closed shutter state;

FIG. 4 is a front, top, and left side perspective view of a portion of the apparatus of FIG. 1A mated to the surrounding window surface of FIG. 2, with a portion of the apparatus of FIG. 1A in a fully open shutter state, such that upper and lower board components have been removed;

DETAILED DESCRIPTION OF THE DRAWINGS

One or more embodiments of the present invention provide a unique apparatus to cover a window in an alternative way. The apparatus has three shutter states: fully open, half open, and fully closed. The present invention is described in enabling detail in the following examples, which may represent more than one embodiment of the present invention.

Figure 1A:
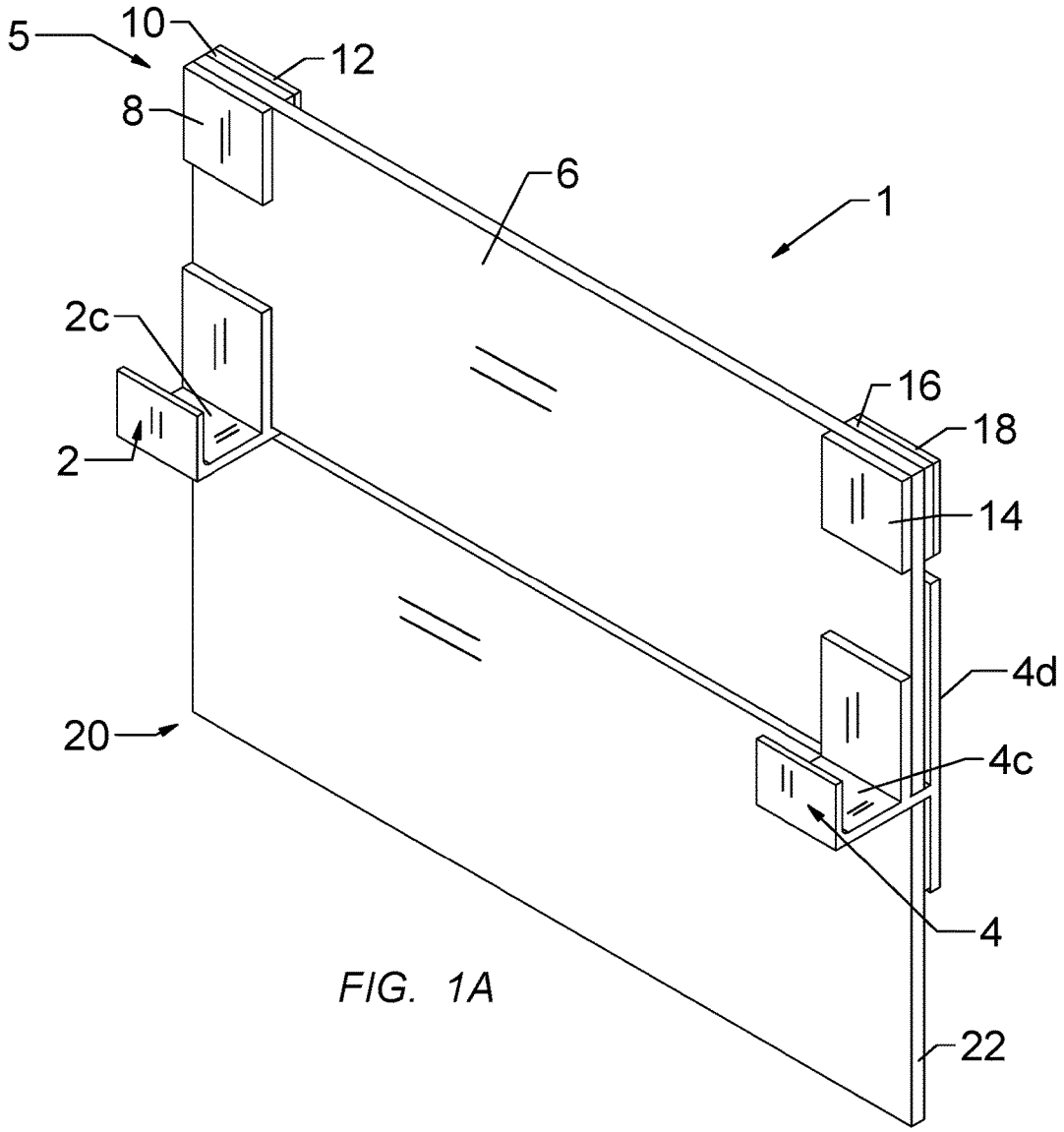
FIG. 1A is a top, front, and right side perspective view of an apparatus in accordance with an embodiment of the present invention, with the apparatus of FIG. 1A shown in a fully closed shutter state.
Figure 1B:
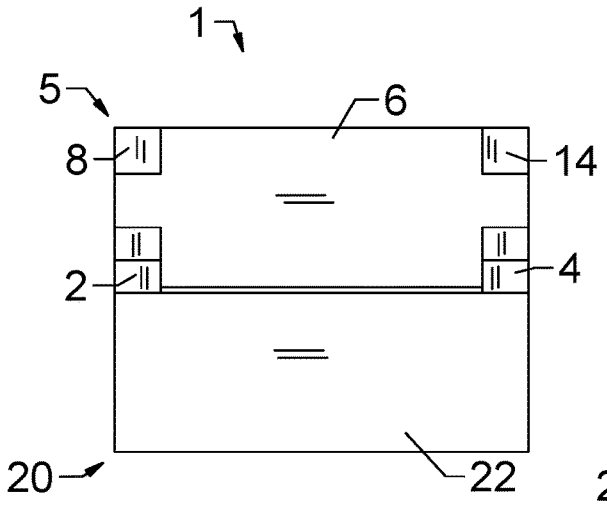
FIG. 1B is a front elevational view of the apparatus of FIG. 1A shown in a fully closed shutter state.

FIG. 1A is a top, front, and right side perspective view of an apparatus 1 in accordance with an embodiment of the present invention, with the apparatus of FIG. 1A shown in a fully closed shutter state. FIG. 1B is a front elevational view of the apparatus 1 of FIG. 1A shown in a fully closed shutter state. FIG. 10 is a rear elevational view of the apparatus 1 of FIG. 1A shown in a fully closed shutter state.

Figure 5:
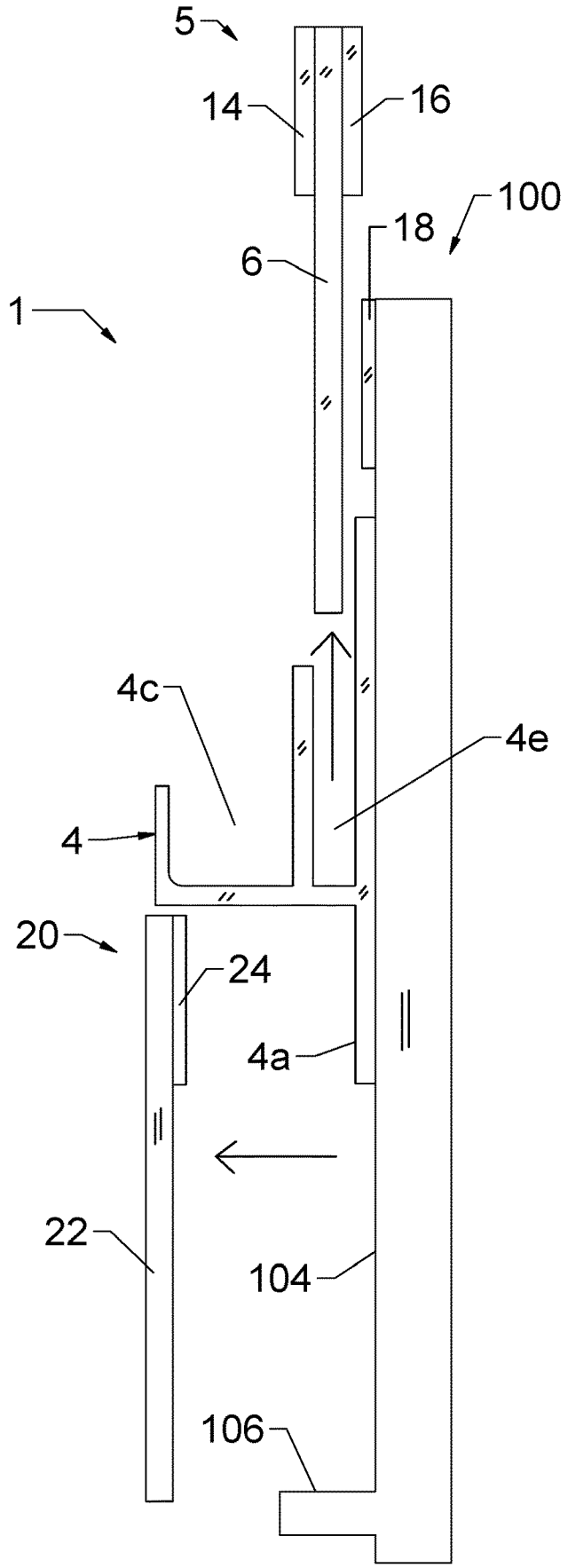
FIG. 5 is a side elevational view of a first part of the apparatus of FIG. 1A mated to the surrounding window surface of FIG. 2, and a second part of the apparatus of FIG. 1A detached from the first part of the apparatus of FIG. 1A.

FIG. 2 is a front and right side perspective view of the apparatus 1 of FIG. 1A mated to surrounding window surfaces 102 and 104 of a window 100, with the apparatus 1 of FIG. 1A shown in a half open shutter state. The window 100 includes a window pane 108 and a window sill 106. FIG. 3 is a front, top, and right side perspective view of the apparatus 1 of FIG. 1A mated to the surrounding window surfaces 102 and 104 of the window 100 of FIG. 2 with the apparatus 1 of FIG. 1A in a fully closed shutter state. FIG. 4 is a front, top, and left side perspective view of a portion of apparatus 1 (wherein the upper board component 5 and the lower board component 20 have been removed and are not shown) of FIG. 1A mated to the surrounding window surfaces 102 and 104 of the window 100 of FIG. 2, with the apparatus 1 of FIG. 1A in a fully open shutter state. FIG. 5 is a side elevational view of a first part of the apparatus 1 of FIG. 1A mated to the surrounding window surfaces 102 and 104 of the window 100 of FIG. 2, and a second part of the apparatus 1 of FIG. 1A detached from the first part of the apparatus 1 of FIG. 1A.

Referring to FIGS. 1-5, the apparatus 1 includes central mounts 2 and 4 that have front faces 2*a* and 4*a*, shown in FIG. 2, and rear faces 2*d* and 4*d*, shown in FIG. 10, respectively. The central mounts 2 and 4 may preferably be constructed integrally from a single piece of suitable, rigid material, such as plastic.

The central mounts 2 and 4 are comprised of central recessed permanent magnets 2*b* and 4*b* (best shown in FIG. 2), front slots 2*c* and 4*c* (best shown in FIG. 1A), and rear slots 2*e* and 4*e* (best shown in FIG. 4), respectively, in this example. As best shown in FIGS. 2-5 the central mounts 2 and 4 are mated to the surrounding window surfaces 102 and 104, respectively, of the window 100. The mating between the central mounts 2 and 4 and the surrounding window surfaces 102 and 104, respectively, is achieved by removable adhesive between the rear faces 2*d* and 4*d* (shown in FIG. 10) of the central mounts 2 and 4, respectively, and the surrounding window surfaces 102 and 104, respectively, in this example.

As best shown in FIG. 1A, there is an upper board component of the present invention shown generally by reference numeral 5. The upper board component 5 is comprised of an upper sheet board 6, which may preferably be constructed integrally from a single piece of suitable rigid material, such as cardboard. Further comprising the upper board component 5 are frontal permanent magnets 8 and 14 and rear permanent magnets 10 and 16 that are attached to the upper sheet board 6 on left and right upper front corners, and left and right upper rear corners, respectively.

As best show in FIG. 4, ferrous metal sheet mounts 12 and 18 are mated to upper corners of the surrounding window surfaces 102 and 104, respectively, by removable adhesive, for example, to help hold the upper board component 5 (as best pictured in FIG. 3) against the surrounding window surfaces 102 and 104.

As best shown in FIG. 5, a further component of the present invention is a lower board component shown generally by reference numeral 20. The lower board component 20 is comprised of a lower sheet board 22, which may preferably be constructed integrally from a single piece of suitable, rigid material, such as cardboard. Further comprising the lower board component 20 are ferrous metal surfaces 24 on both upper rear right and left corners of the lower sheet board 22. The ferrous metal surface 24 is permanently mated to the lower sheet board 22 with a permanent adhesive, for example.

The following explains the ease of installation of the current embodiment of the present invention.

The lower board component 20 magnetically engages the front faces 2*a* and 4*a* of the central mounts 2 and 4, respectively, at the interface between the ferrous metal surfaces 24 and the central recessed permanent magnets 2*b* and 4*b*, respectively. As the lower board component 20 is magnetically engaged with the central mounts 2 and 4 at ends of the lower sheet board 22, the lower board component 20 is placed squarely on the window sill 106, and the rear faces 2*d* and 4*d* of the central mounts 2 and 4 are mated to the surrounding window surfaces 102 and 104, respectively, by for example removable adhesive. In this example, the lower board component 20 is supported from the bottom by the window sill 106 and is held in place by the magnetic pull from the central recessed permanent magnets 2*b* and 4*b*.

The ferrous metal sheet mounts 12 and 18 engage the rear permanent magnets 10 and 16, respectively, of the upper board component 5. The upper board component 5 is now slid into the rear slots 2*e* and 4*e* of the central mounts 2 and 4, respectively, and the ferrous metal sheet mounts 12 and 18 are mated to the surrounding window surfaces 102 and 104, respectively, by, for example, removable adhesive. The central mounts 2 and 4 support the upper board component 5 from the bottom and the magnetic pull from the rear permanent magnets 10 and 16 hold the upper board component 5 in place.

The following explains the different states and function of the current embodiment of the present invention.

Figure 1C:
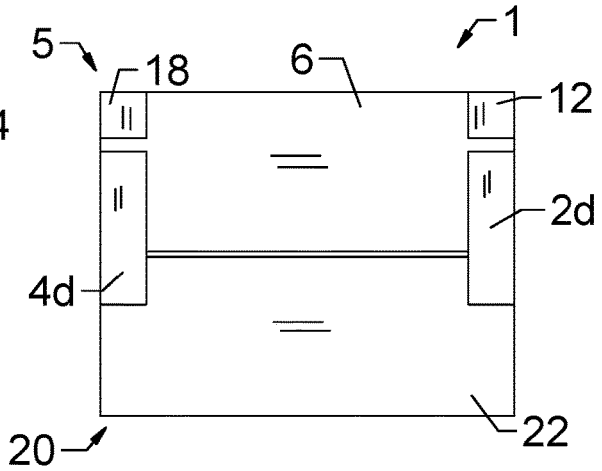
FIG. 1C is a rear elevational view of the apparatus of FIG. 1A shown in a fully closed shutter state.

FIG. 1A depicts the apparatus 1 in a fully closed shutter state by itself. FIG. 1B depicts the front elevational view of the apparatus 1 by itself. FIG. 1C depicts the rear elevational view of the apparatus 1 by itself.

FIG. 2 depicts the current embodiment of the present invention in a half open shutter state. The lower board component 20 is able to be pulled outward, as depicted in FIG. 5, and placed in the front slots 2*c* and 4*c* of the central mounts 2 and 4, respectively, and held in place by a magnetic engagement between the frontal permanent magnets 8 and 14 of the upper board component 5 and the ferrous metal surfaces 24 of the lower board component 20, as depicted in FIG. 2.

FIG. 3 depicts the current embodiment of the present invention in a fully closed shutter state mated to the surrounding window surfaces 102 and 104 with the lower board component 20 magnetically engaged with the front faces 2*a* and 4*a* of the central mounts 2 and 4, respectively, and positioned below the upper board component 5. The upper board component 5 is inserted in the rear slots 2*e* and 4*e* of the central mounts 2 and 4 and is magnetically engaged to the ferrous metal sheet mounts 12 and 18, which is mated to the surrounding window surfaces 102 and 104, respectively.

FIG. 4 depicts the current embodiment of the present invention in a fully open shutter state mated to the surrounding window surfaces 102 and 104. The lower board component 20 is able to be pulled outward as depicted in FIG. 5 and set aside. The upper board component 5 is able to be removed by lifting it upward out of the rear slots 2*e* and 4*e* of the central mounts 2 and 4, respectively, as depicted in FIG. 5, and set aside. Thus, the ferrous metal sheet mounts 12 and 18 and the central mounts 2 and 4 remain mated to the surrounding window surfaces 102 and 104, as depicted in FIG. 4.

It will be appreciated by those skilled in the art that, instead of having the central recessed permanent magnets 2*b* and 4*b*, the frontal permanent magnets 8 and 14, and the rear permanent magnets 10 and 16 being permanent magnets, one can have the said be ferrous metal and have the ferrous metal surfaces 24 (shown in FIGS. 3 and 5) and ferrous metal surfaces 12 and 18 (shown best in FIG. 1A and FIG. 4) be a permanent magnet, achieving the same result.

Figure 6:
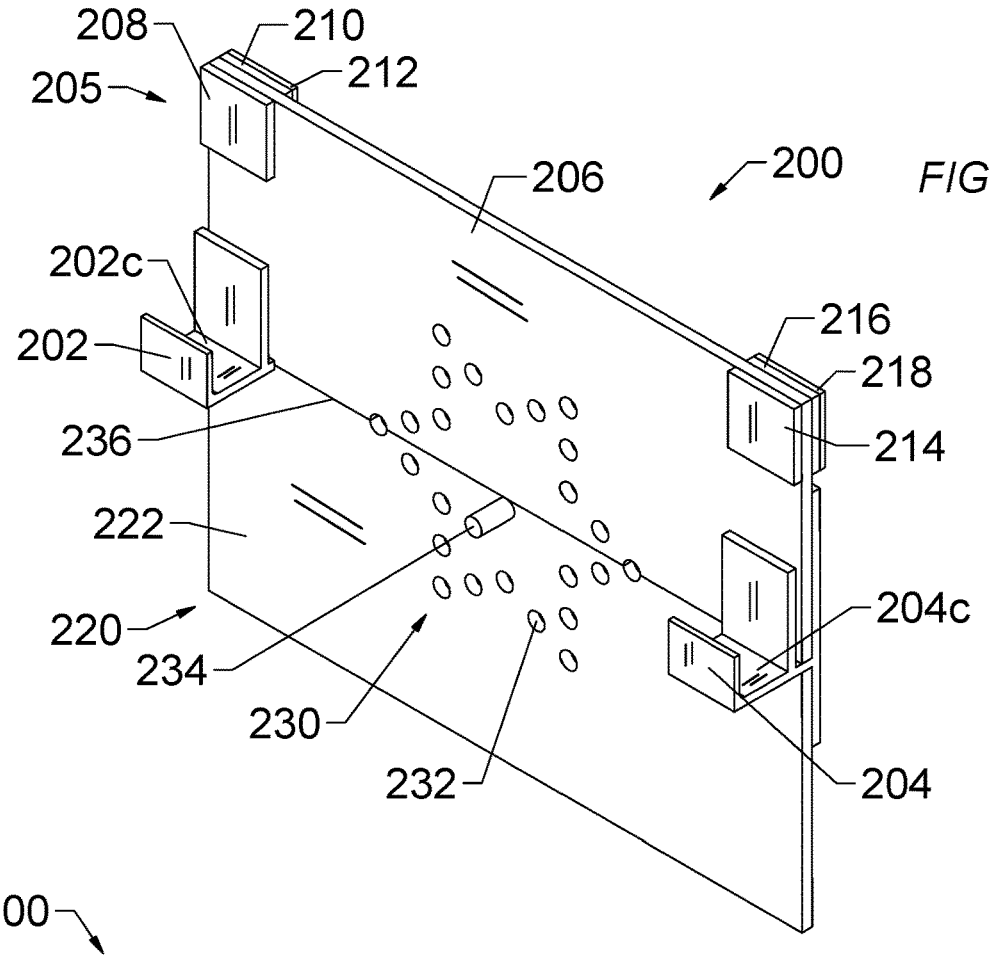
FIG. 6 is a front, top, and right side perspective view of another apparatus in accordance with another embodiment of the present invention showing an ornamental design, a pull tab, and a gapless seam in a fully closed shutter state.
Figure 7:
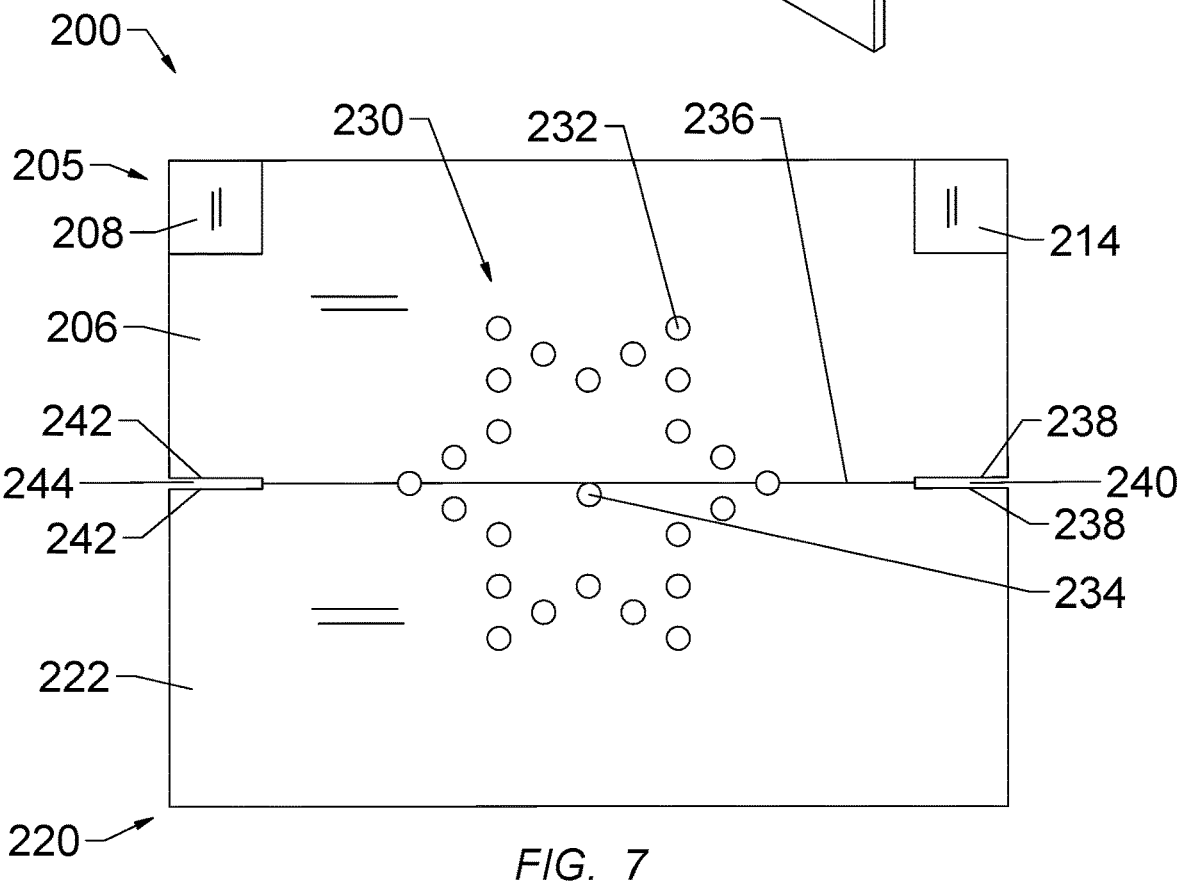
FIG. 7 is a frontal elevational view of part of the apparatus of FIG. 6 with central mounts not depicted to show slots which help achieve a gapless seam in a fully closed shutter state.

Turning now to FIGS. 6-7, there are represented two illustrations for a further embodiment of the present invention.

FIG. 6 is a perspective view of an apparatus 200. The apparatus 200 may be identical to the apparatus 1 of FIGS. 1-5, except as will be explained. The apparatus 200 may include components 202, 202*c*, 204, 204*c*, 205, 206, 208, 210, 212, 214, 216, 218, 220, and 222, which may be identical to components 2, 2*c*, 4, 4*c*, 5, 6, 8, 10, 12, 14, 16, 18, 20, and 22, respectively, except as will be described below.

The apparatus 200 may include a star-shaped design 230. The star-shaped design 230 is comprised of a plurality fully extending holes 232. There is a central pull tab 234 on the lower board component 220, which protrudes to assist with disengaging the lower board component 220 from the front faces (identical to front faces 2*a* and 4*a*) of the central mounts 202 and 204.

It will be appreciated by those skilled in the art that instead of having the star-shaped design 230, one can use any ornamental design or depiction, either being comprised of fully extended holes, two dimensional drawings, or any other type of decorative technique, achieving the same result, which is decorative in nature. Furthermore, it will be appreciated by those skilled in the art that, instead of having the central pull tab 234, one can use any number of pull tabs placed in any area, achieving the same result.

FIG. 7 is a frontal elevational view of the current embodiment with the central mounts 202 and 204 not shown to aid in depicting cuts 242 and 238 on the bottom corners of the upper sheet board 206 and on the top corners of the lower sheet board 222. These cuts 242 and 238 create slots 244 and 240 in which the central mounts 202 and 204, respectively, fit; the purpose of which is to create a gapless seam 236 (shown in FIG. 6) between the upper sheet board 206 and the lower sheet board 222 in a fully closed shutter state.

Although the invention has been described by reference to particular illustrative embodiments thereof, many changes and modifications of the invention may become apparent to those skilled in the art without departing from the spirit and scope of the invention. It is therefore intended to include within this patent all such changes and modifications as may reasonably and properly be included within the scope of the present invention's contribution to the art.

I claim:

1. A window covering apparatus comprising:

an upper board component and a lower board component; and one or more central mounts, which engage one or more window surfaces of a window outside of one or more glass panels of the window, and which are configured to releasably attach the said upper board component and the said lower board component to the one or more window surfaces of the window in any one of a half open shutter state or a fully closed shutter state, and to allow the upper board component and the lower board component to be detached from the one or more window surfaces in a fully open shutter state;

wherein the one or more central mounts include a first central mount;

wherein the first central mount includes a front slot, a rear slot, a front face, and a rear face, which is opposite the front face of the first central mount; and wherein the rear face of the first central mount is configured to be attached to a window surface of the one or more window surfaces so that the front face of the first central mount is below both the front slot and the rear slot of the first central mount and so that the upper board component is configured to be at least partially placed in the rear slot of the first central mount so that the upper board component at least partially sits in the rear slot of the first central mount, and the lower board component simultaneously is configured to be placed below the front and rear slots of the first central mount so that the lower board component becomes attached to a magnet which is below the front and rear slots of the first central mount, and within the front face of the first central mount.

2. The window covering apparatus of claim 1 wherein the one or more central mounts include a second central mount;

wherein the second central mount includes a front slot, a rear slot, a front face, and a rear face which is opposite the front face of the second central mount; and wherein the rear face of the second central mount is configured to be attached to a window surface of the one or more window surfaces so that the front face of the second central mount is below both the front slot and the rear slot of the second central mount and so that the upper board component is configured to be at least partially placed in the rear slot of the second central mount so that the upper board component at least partially sits in the rear slot of the second central mount, and the lower board component simultaneously is configured to be placed below the front and rear slots of the second central mount so that the lower board component becomes attached to a magnet which is below the front and rear slots of the second central mount, and within the front face of the second central mount.

3. The window covering apparatus of claim 2 wherein the lower board component includes a pull tab configured to detach the lower board component from the magnet which is within the front face of the first central mount and from the magnet which is within the front face of the second central mount.

4. The window covering apparatus of claim 1 wherein the lower board component includes a pull tab configured to detach the lower board component from the magnet which is within the front face of the first central mount.

5. The window covering apparatus of claim 1 further comprising one or more sheet mounts configured to be attached to the one or more window surfaces; and wherein the upper board component is configured to be attached to the one or more sheet mounts to attach the upper board component to the one or more window surfaces.

6. The window covering apparatus of claim 5 further comprising one or more magnets; and wherein the upper board component is configured to be attached to the one or more sheet mounts through the one or more magnets.

7. The window covering apparatus of claim 1 wherein in the fully closed shutter state, the upper board component, and the lower board component do not overlap each other; and in the half open shutter state, the lower board component overlaps the upper board component.

8. The window covering apparatus of claim 7 wherein in the half open shutter state, the lower board component is attached to the upper board component by one or more magnets.

9. The window covering apparatus of claim 7 wherein in the fully closed shutter state, the lower board component is attached to the one or more central mounts by one or more magnets.

10. A method comprising the steps of:

attaching one or more central mounts of a window covering apparatus to one or more surfaces of a window outside of one or more glass panels of the window;

wherein the window covering apparatus includes an upper board component and a lower board component; and wherein the one or more central mounts are configured to releasably attach the said upper board component and the said lower board component to the one or more surfaces of the window in any one of a fully closed shutter state or a half open shutter state, and to allow the upper board component and the lower board component to be detached from the one or more surfaces of the window in a fully open shutter state;

wherein the one or more central mounts include a first central mount;

wherein the first central mount includes a front slot, a rear slot, a front face, and a rear face which is opposite the front face of the first central mount; and wherein the rear face of the first central mount is configured to be attached to a window surface of the one or more window surfaces so that the front face of the first central mount is below both the front slot and the rear slot of the first central mount and so that the upper board component is configured to be at least partially placed in the rear slot of the first central mount so that the upper board component at least partially sits in the rear slot of the first central mount, and the lower board component simultaneously is configured to be placed below the front and rear slots of the first central mount so that the lower board component becomes attached to a magnet which is below the front and rear slots of the first central mount, and within the front face of the first central mount.

11. The method of claim 10 further comprising attaching the lower board component to the one or more central mounts, and attaching the upper board component to the surfaces of the window so that the lower board component does not overlap the upper board component in the fully closed shutter state.

12. The method of claim 10 further comprising attaching the upper board component to at least one of the one or more surfaces of the window and attaching the lower board component to the upper board component so that the lower board component overlaps the upper board component in the half open shutter state.

13. The method of claim 11 wherein the lower board component is attached to the one or more central mounts, and the upper board component is attached to the one or more surfaces of the window by one or more magnets.

14. The method of claim 12 wherein the upper board component is attached to the one or more surfaces of the window and the lower board component is attached to the upper board component by one or more magnets.

15. The method of claim 10 wherein the one or more central mounts include a second central mount;

wherein the second central mount includes a front slot, a rear slot, a front face, and a rear face which is opposite the front face of the second central mount; and wherein the rear face of the second central mount is configured to be attached to a window surface of the one or more window surfaces so that the front face of the second central mount is below both the front slot and the rear slot of the second central mount and so that the upper board component is configured to be at least partially placed in the rear slot of the second central mount so that the upper board component at least partially sits in the rear slot of the second central mount, and the lower board component simultaneously is configured to be placed below the front and rear slots of the second central mount so that the lower board component becomes attached to a magnet which is below the front and rear slots of the second central mount, and within the front face of the second central mount.

16. The method of claim 10 wherein the lower board component includes a pull tab configured to detach the lower board component from the magnet which is within the front face of the first central mount.

17. The method of claim 10 wherein the window covering apparatus includes one or more sheet mounts configured to be attached to the one or more surfaces of the window; and wherein the upper board component is configured to be attached to the one or more sheet mounts to attach the upper board component to the one or more surfaces of the window.

18. The method of claim 17 wherein the window covering apparatus includes one or more magnets; and wherein the upper board component is configured to be attached to the one or more sheet mounts through the one or more magnets.

* * * * *